United States Patent [19]

Nakashima et al.

[11] Patent Number: 4,652,308

[45] Date of Patent: Mar. 24, 1987

[54] PROCESS FOR REFINING MOLTEN STEEL

[75] Inventors: Hirohisa Nakashima; Yoshimi Komatsu; Masafumi Ikeda; Tsuneo Kondo, all of Fukuyama, Japan

[73] Assignee: Nippon Kokan Kabushiki Kaisha, Tokyo, Japan

[21] Appl. No.: 782,527

[22] Filed: Oct. 1, 1985

[30] Foreign Application Priority Data

Oct. 12, 1984 [JP] Japan ..... 59-213330
Oct. 12, 1984 [JP] Japan ..... 59-213333

[51] Int. Cl.[4] ..... C21C 7/10
[52] U.S. Cl. ..... 75/49; 75/58
[58] Field of Search ..... 75/49, 58, 46

[56] References Cited

U.S. PATENT DOCUMENTS 3,467,167 9/1969 Mahin ..... 75/58

OTHER PUBLICATIONS

"The Making, Shaping and Treating of Steel", Eighth Edition (1964), pp. 551 and 552.

Urushiyama et al., Research and Development in Japan Awarded the Okochi Memorial Prize, 1982, pp. 22–28.

*Primary Examiner*—Peter D. Rosenberg

*Attorney, Agent, or Firm*—Frishauf, Holtz, Goodman & Woodward

[57] ABSTRACT

The invention provides a process for obtaining low-nitrogen steel by tapping molten steel from a converter without deoxidizing and by then deoxidizing the molten steel in a ladle refining furnace from which slag has been removed, and a process for obtaining low phosphorus steel by tapping molten steel from a converter without deoxidation at a tapping temperature lower than conventional processes, and by performing deoxidation and composition adjustment of the molten steel in a ladle refining furnace from which slag has been removed.

9 Claims, 1 Drawing Figure

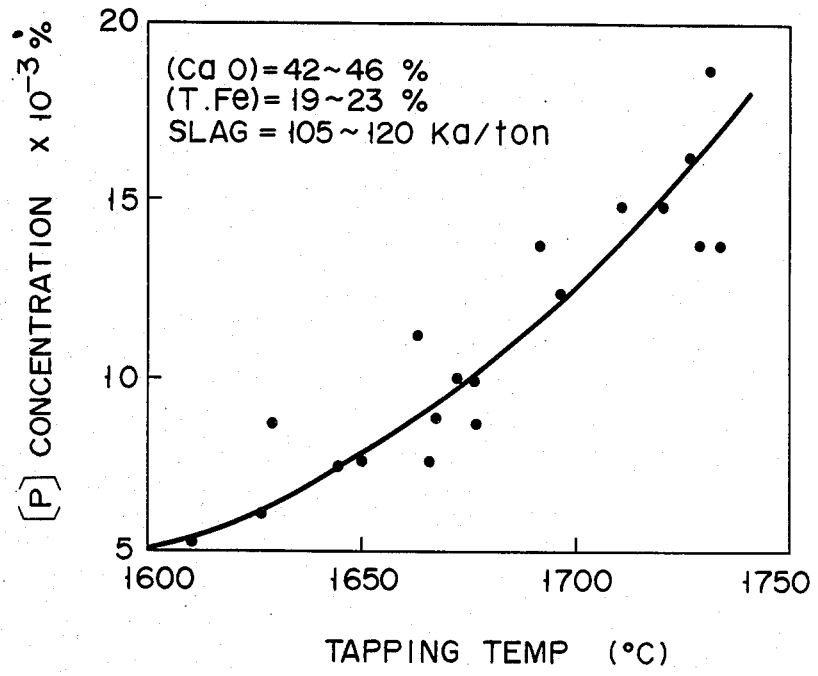
(Ca O)=42~46 %
(T.Fe)= 19~23 %
SLAG = 105~120 Kg/ton
〔P〕 CONCENTRATION x 10⁻³ %
20
15
10
5
1600
1650
1700
1750
TAPPING TEMP (°C)

PROCESS FOR REFINING MOLTEN STEEL

BACKGROUND OF THE INVENTION

1. Field of the Invention

The present invention relates to a process for refining molten steel using a ladle refining furnace and, more particularly, to a process for refining molten steel to obtain low-nitrogen steel or low-phosphorus steel.

2. Description of the Prior Art

In a conventional process for refining molten steel, blowing of molten steel is performed in a converter for refining. After the temperature is raised to about 1700° C., the steel is tapped into a ladle, and a deoxidizing agent and a ferro alloy are charged into the steel upon tapping. The molten steel in the ladle is bubbled in the presence of slag so as to adjust the composition of the steel.

When the $O_2$ concentration in molten steel decreases, the $N_2$ adsorption capacity of molten steel increases. In the above-mentioned conventional refining process, the $N_2$ adsorption capacity of the molten steel is increased since deoxidation is performed during tapping. This causes inclusion of $N_2$ into the molten steel or pick-up of $N_2$, thereby increasing the $N_2$ concentration in the molten steel.

Aluminum as a deoxidizing agent partially reacts with slag, lessening its contribution to deoxidation. In view of this, aluminum must be added in an excess amount in consideration of the fraction which reacts with slag. In association with this problem, the amount of aluminum which reacts with slag changes in each refining process. For this reason, even if aluminum is added in a predetermined amount, the deoxidation amount varies in each refining process and desired deoxidation cannot be performed.

The phosphorus concentration in the molten steel upon tapping is proportional to the tapping temperature of the molten steel. FIG. 1 shows a relationship between the tapping temperature and the phosphorus concentration in molten steel after blowing. In the conventional refining process, the phosphorus concentration increases since the tapping temperature is as high as about 1,700° C. Bubbling in a ladle is performed for deoxidized molten steel and in the presence of slag. Therefore, phosphorus in the slag causes rephosphorization of molten steel, and the phosphorus concentration increases. In the conventional refining process, phosphorus concentration can be reduced to only about 150 ppm.

SUMMARY OF THE INVENTION

The first object of the present invention is to provide a process for refining molten steel, which can produce low-nitrogen steel with reliability.

It is a second object of the present invention to provide a process for refining molten steel, which requires the addition of only a small amount of aluminum and which can reliably perform desired deoxidation.

It is a third object of the present invention to provide a process for refining molten steel, which can produce low-phosphorus steel.

In order to achieve the first and second objects of the present invention, there is provided a process for refining molten steel, comprising the steps of tapping molten steel from a converter into a ladle refining furnace without deoxidation, removing slag from the molten steel in the ladle refining furnace, and adding at least one deoxidizing agent to the molten steel in the ladle refining furnace from which the slag has been removed.

According to the process of the present invention, molten steel is tapped from a converter into a ladle refining furnace without deoxidation. For this reason, the molten steel has a low $N_2$ adsorption capacity, so that $N_2$ inclusion or pick-up can be prevented and low-nitrogen steel can be reliably obtained. In addition, after the slag is removed, at least one deoxidizing agent is added to the molten steel to deoxidize it in the ladle refining furnace. Since deoxidation is thus not influenced by slag, stable and reliable deoxidation can be performed with addition of only a small amount of at least one deoxidizing agent.

In order to achieve the third object of the present invention, there is provided a process for refining molten steel, comprising the steps of tapping molten steel from a converter into a ladle refining furnace at a tapping temperature of 1,600° to 1,650° C. without deoxidation, removing slag from the molten steel in the ladle refining furnace, adding at least one deoxidizing agent and at least one ferro alloy to the molten steel in the ladle refining furnace from which the slag has been removed, stirring the molten steel to perform deoxidation and composition adjustment of the molten steel, and heating the molten steel to a predetermined temperature.

According to this process, since molten steel is tapped at a temperature lower than the conventional tapping temperature, the phosphorus concentration in the tapped molten steel is lowered. Furthermore, after slag is removed from the molten steel in the ladle refining furnace, at least one deoxidizing agent and at least one ferro alloy are added to perform deoxidation and composition adjustment of the molten steel. Therefore, rephosphorization is prevented, and molten steel having a very low phosphorus concentration as compared to conventional molten steel can be obtained.

BRIEF DESCRIPTION OF THE DRAWING

The single drawing is a graph showing an example of the relationship between the tapping temperature and the phosphorus concentration in molten steel after blowing.

DETAILED DESCRIPTION OF THE PREFERRED EMBODIMENT

According to the process of the present invention, when molten steel is tapped from a converter, a deoxidizing agent and a ferro alloy are not added. Thus, molten steel is tapped before being deoxidized.

When molten steel is tapped in a non-deoxidized state, since the $N_2$ adsorption capacity can be kept low, $N_2$ inclusion or pick-up into molten steel during tapping can be prevented. As a result, an increase in the nitrogen concentration in the molten steel in a ladle refining furnace can be prevented. Furthermore, since at least one deoxidizing agent and at least one ferro alloy are not added during tapping, reaction with slag does not occur, thus preventing rephosphorization of molten steel by phosphorus in the slag. Accordingly, an increase in the phosphorus concentration in the tapped molten steel can be prevented.

In order to reduce the phosphorus concentration in molten steel, the tapping temperature of molten steel from a converter is set to be 1,600° to 1,650° C. This temperature is lower than the conventional tapping temperature, i.e., 1,700° C. When this lower tapping temperature is adopted, the phosphorus concentration in the tapped molten steel can be reduced. Dephosphorization of molten steel can be positively performed by adding a dephosphorizing agent, e.g., sodium metasilicate or a mixture of lime with an iron oxide.

Slag is removed from the molten steel in the ladle refining furnace to a degree where it does not adversely influence the molten steel. Slag can be removed from the molten steel by vacuum suction.

Al as a deoxidizing agent is added to molten steel in the ladle refining furnace from which slag has been removed. When composition adjustment is performed, a ferro alloy, e.g. Fe-Mn, Fe-Si, is added to the molten steel together with the deoxidizing agent. After or during addition of the aluminum, the molten steel is stirred. Since slag has been removed, aluminum cannot react with slag and only a minimum amount of Al required for deoxidation need be added. Since Al is not affected by slag, stable deoxidation can be performed. Desired deoxidation can be performed by adding a predetermined amount of Al, and the Al concentration in the molten steel can be controlled to be about 0.015% with small error.

Since slag is removed, rephosphorization will not occur even after addition of a deoxidizing agent and a ferro alloy so that the phosphorus concentration in the molten steel can be kept low. The type and amount of the deoxidizing agent and ferro alloy added can be determined as in conventional processes.

Since the temperature of the molten steel gradually decreases, it is heated by 50° to 80° C. to, e.g., 1,630° C. during addition of the deoxidizing agent and the ferro alloy and stirring of the molten steel. If necessary, RH process is performed.

Subsequently, the molten steel refined in the ladle refining furnace is continuously cast.

The present invention will now be described by way of its Examples.

EXAMPLE 1

Ordinary pig iron was tapped from a converter to a ladle refining furnace at a tapping temperature of 1,630° C. without deoxidation. After removing slag from the tapped molten steel by vacuum suction, Al was added in the amount of 1.20 kg/ton to deoxidize the molten steel. The obtained steel had an $N_2$ concentration of 15 to 20 ppm.

COMPARATIVE EXAMPLE 1

When ordinary pig iron as in Example 1 was tapped from a converter, Al was added in the amount of 1.55 kg/ton to deoxidize the molten steel. The obtained steel had an $N_2$ concentration of 20 to 30 ppm.

As can be seen from a comparison of Example 1 and Comparative Example 1, the $N_2$ and Al concentrations of the steel can be reduced, and variations in the $N_2$ concentration are small.

EXAMPLE 2

A mixture of ordinary pig iron and dephosphorized pig iron was tapped from an LD converter at a tapping temperature of 1,650° C. without deoxidation. The slag concentration with respect to the molten steel was 15 kg/ton. In a ladle refining furnace charged with molten steel, sodium metasilicate was added in the amount of 4 kg/ton and the molten steel was stirred by Ar gas supplied at a flow rate of 0.5 Nl/min for 15 minutes. Slag on the molten steel was removed by vacuum suction. Thereafter, a ferro alloy and Al as a deoxidizing agent were added to the molten steel and the molten steel was stirred by Ar gas. At the same time, the molten steel was heated to 1,630° C.

The phosphorus concentration in the obtained steel was found to be 60 to 100 ppm for the ordinary pig iron and 40 to 80 ppm for the mixture pig iron.

COMPARATIVE EXAMPLE 2

Ordinary pig iron and mixture pig iron as in Example 2 were separately charged into an LD converter and tapped at a tapping temperature of 1,700° C. During tapping, Al as a deoxidizing agent and a ferro alloy were added. This molten steel was charged in a ladle and was stirred without removing slag.

When the phosphorus concentration in the steel obtained in this manner was examined, it was found to be 150 to 200 ppm for the ordinary pig iron and 100 to 150 ppm for the mixture pig iron.

As can be seen from a comparison of Example 2 and Comparative Example 2, the phosphorus concentration in steel can be reduced.

What is claimed is:

1. A process for refining molten steel, comprising the steps of:
   - tapping molten steel from a converter to a ladle refining furnace without deoxidation;
   - removing slag from the molten steel in said ladle refining furnace; and
   - adding an amount of at least one deoxidizing agent to the molten steel in said ladle refining furnace from which the slag has been removed to substantially deoxidize said molten steel.

2. The process according to claim 1, wherein the step of removing the slag is performed by vacuum suction.

3. The process according to claim 1, wherein the deoxidizing agent is aluminum.

4. A process for refining molten steel, comprising the steps of:
   - tapping molten steel from a converter to a ladle refining furnace of a tapping temperature of 1,600° C. to 1,650° C. without deoxidation;
   - removing slag from the molten steel in said ladle refining furnace; and
   - adding an amount of at least one deoxidixing agent and at least one ferro alloy to the molten steel in said ladle refining furnace from which the slag has been removed to substantially deoxidize said molten steel, stirring the molten steel to perform deoxidation and composition adjustment of the molten steel, and heating the molten steel to a predetermined temperature.

5. The process according to claim 4, wherein the step of removing the slag is performed by vacuum suction.

6. The process according to claim 4, wherein the step of heating is to heat the molten steel to about 1,630° C.

7. The process according to claim 4, wherein said deoxidizing agent is aluminum and wherein said ferro alloy is Fe-Mn or Fe-Si.

8. The process according to claim 6, wherein said deoxidizing agent is aluminum and wherein said ferro alloy is Fe-Mn or Fe-Si; and wherein the slag is removed by vacuum suction.

9. The process according to claim 3, wherein the slag is removed by vacuum suction.

* * * * *